US005282450A

United States Patent [19]

Uchida et al.

[11] Patent Number: 5,282,450

[45] Date of Patent: Feb. 1, 1994

[54] ENGINE POWER CONTROLLER

[75] Inventors: Masaaki Uchida; Hiroyuki Itoyama, both of Yokosuka, Japan

[73] Assignee: Nissan Motor Co., Ltd., Japan

[21] Appl. No.: 960,640

[22] Filed: Oct. 14, 1992

[30] Foreign Application Priority Data

Oct. 16, 1991 [JP] Japan ..... 3-267766

[51] Int. Cl.[5] ..... F02D 43/00

[52] U.S. Cl. ..... 123/399

[58] Field of Search ..... 123/399, 344, 403, 400

[56] References Cited

U.S. PATENT DOCUMENTS 4,453,516 6/1984 Filsinger ..... 123/400

4,759,329 7/1988 Nobuo et al. ..... 123/399

FOREIGN PATENT DOCUMENTS 60-45742 3/1985 Japan .

*Primary Examiner*—Andrew M. Dolinar

*Attorney, Agent, or Firm*—Lowe, Price, LeBlanc & Becker

[57] ABSTRACT

An engine wherein a target air-fuel ratio is changed over according to the running conditions is provided with a device for computing a target throttle opening area based on the accelerator operation and a selected air-fuel ratio. It also includes a device for correcting the throttle opening such that the throttle opening area is equal to a target throttle opening area, a device for computing a fuel amount to be provided to the engine based on the target air-fuel ratio, intake air volume and engine speed, and a device for regulating the fuel supply to the computed amount. In this way, the throttle valve opening is corrected when the air-fuel ratio is changed, fluctuations in the torque generated by the engine are smoothed out, and torque shock due to the air-fuel ratio change-over is thereby prevented.

3 Claims, 7 Drawing Sheets

ENGINE POWER CONTROLLER

FIELD OF THE INVENTION

This invention relates to an engine power controller provided with an air-fuel ratio change-over mechanism.

BACKGROUND OF THE INVENTION

In order to achieve the dual conditions of high output and low fuel consumption in automobile engines, a lean combustion technique is known wherein the air-fuel ratio (hereinafter referred to as AFR) is changed to provide leaner AFR than the theoretical AFR value corresponding to the engine running conditions.

In Tokkai Sho 60-45742 published by the Japanese Patent Office, an AFR controller is disclosed wherein the AFR is changed to a leaner AFR than the theoretical AFR when, for example, the cooling water temperature is greater than 80° C., the throttle valve opening is no greater than a predetermined value, and the rate of change of the speed of the vehicle is no greater than a predetermined value.

In this AFR controller, however, the fuel quantity supplied to the engine fluctuates sharply when the AFR is changed over, and the torque produced by the engine fluctuates widely. A torque shock therefore occurs, and passengers in the vehicle experience an uncomfortable jolt.

SUMMARY OF THE INVENTION

It is therefore a principal object of this invention to eliminate torque variations due to change-over of the AFR, and thereby to prevent the occurrence of torque shock.

In order to achieve the above object, this invention provides a power controller for an engine provided with a combustion chamber, a throttle having a variable opening area to regulate an intake air flow supplied to the combustion chamber, an accelerator which operates the throttle, and a device for supplying a fuel flow to the combustion chamber.

The controller comprises a device for selecting an air-fuel ratio from among a plurality of candidate air-fuel ratios, a device for computing a target throttle opening area based on an operation amount of the accelerator and the selected air-fuel ratio, a device for correcting the opening of the throttle such that the opening area is equal to the computed target throttle opening area, a device for detecting the intake air volume, a device for detecting the engine speed, a device for computing a fuel amount based on the selected air-fuel ratio, detected intake air volume and detected engine speed, and a device for regulating the fuel amount supplied by the fuel supplying device to the computed fuel amount.

It is preferable that the target throttle opening area computing device computes the target throttle opening area such that the ratio of the target throttle opening area and the selected air-fuel ratio is constant when a different air-fuel ratio is selected.

It is also preferable that the correcting device comprises a throttle actuator which can vary the throttle opening area independently of the accelerator operation according to the target throttle opening area.

It is also preferable that the correcting device comprises a throttle opening ratio varying mechanism which mechanically connects the accelerator and the throttle, and varies the ratio of the accelerator operation amount in correspondence with the throttle opening area based on the target throttle opening area.

The details as well as other features and advantages of this invention are set forth in the remainder of the specification and are shown in the accompanying drawings.

DESCRIPTION OF THE PREFERRED EMBODIMENTS

Figure 1:
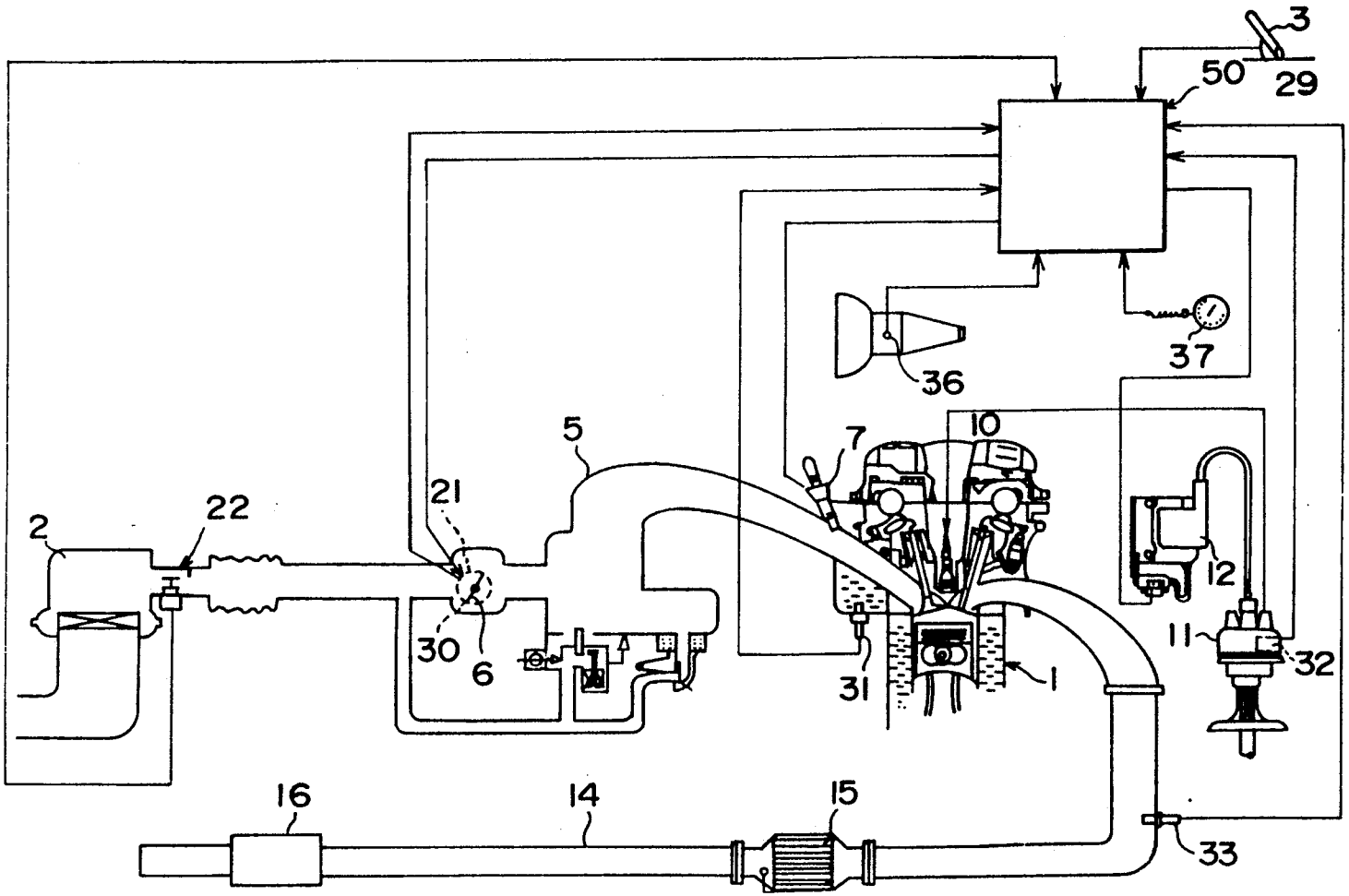
FIG. 1 is a schematic diagram of a power controller according to this invention.

Referring to FIG. 1 of the drawings, the intake air of an engine 1 driving a vehicle passes through a throttle valve 6 from an air cleaner 2, and is supplied to each cylinder of the engine from a corresponding branch of an intake manifold 5. Fuel is injected into this branch from an injector 7 installed in each cylinder.

A spark plug 10 is installed in each cylinder, this spark plug 10 being supplied with a high voltage pulse from an ignition coil 12 via a distributor 11. Due to the discharge of the spark plug 10, the gas mixture in each cylinder ignites and explodes, producing exhaust gas which flows into a catalytic converter 15 via an exhaust pipe 14. CO, HC and NOx, which are toxic ingredients in the exhaust gas, are eliminated by the converting action of a three-way catalyst, and the gas is discharged via a muffler 16.

A throttle actuator 21 consisting of a servomotor or the like is installed in the throttle valve 6. The opening of the throttle valve 6 can be controlled independently of the depression amount of the accelerator pedal 3 by means of a control signal sent to the throttle actuator 21, and the intake air volume is varied according to the throttle opening. The depression amount of the accelerator pedal 3, i.e. the accelerator angle, is detected by an accelerator sensor 29.

The intake air volume is detected by an air flow meter 2, the opening of the throttle valve 6 is detected by a throttle sensor 30, the cooling water temperature is detected by a water temperature sensor 31, and the engine crank angle is detected by a crank angle sensor 32 installed in the distributor 11. Engine speed is also detected by calculating a pulse which represents the crank angle. An oxygen sensor 33 is fitted to the exhaust pipe 14. This oxygen sensor 33 detects the AFR from the oxygen concentration in the exhaust gas.

A position sensor 36 detects the position of the transmission gears with which the vehicle is equipped, and a speed sensor 37 detects the running speed of the vehicle.

The signals from each of these sensors are input to a control unit 50 which controls the ignition timing, fuel injection amount and intake air volume based on these signals.

The control unit 50 changes over the target AFR depending on the running conditions, computes a target throttle opening depending on the accelerator angle and target AFR, and drives the throttle actuator 21 so that the throttle opening coincides with the computed target value. It also computes the fuel injection amount required depending on the intake air volume, engine speed and aforesaid target AFR, and controls the injector 7 so that this computed fuel amount is injected.

This control process will now be described with reference to the flowchart of FIG. 5.

In step 510, the target AFR is changed over depending on running conditions of the engine and vehicle such as the cooling water temperature, vehicle's speed change rate, and throttle valve opening. The running conditions at which the target AFR is changed over are predetermined by a map. If for example the cooling water temperature is 80° C. or more, the throttle valve opening is no greater than a predetermined value and the vehicle's speed change rate is no greater than a predetermined value, the target AFR is changed over to a lean AFR from the theoretical AFR.

In step 520, a target throttle opening angle $\theta t$ is computed according to the depression angle $\theta a$ of the accelerator pedal 3 and the target AFR.

Figure 6:
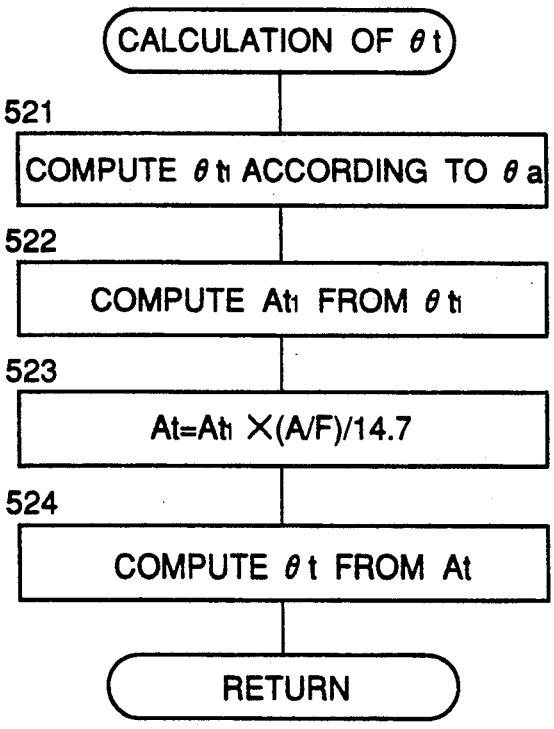
FIG. 6 is a flowchart showing steps in the process for computing a target throttle opening according to this invention.
Figure 7:
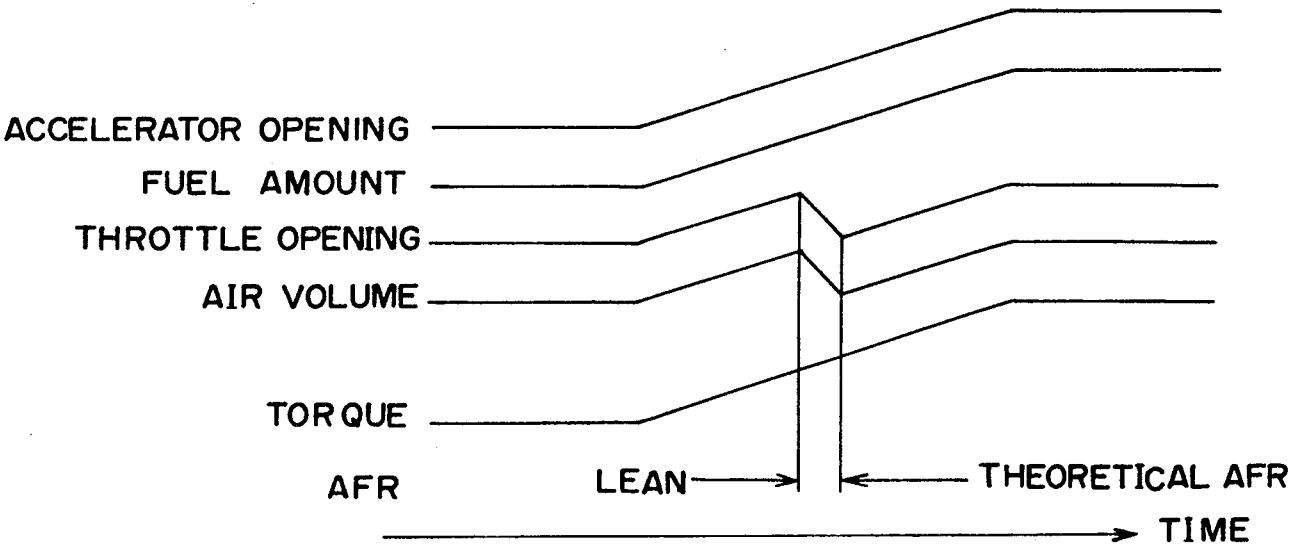
FIG. 7 is a timing chart showing steps in the throttle control process according to this invention.

This computation of the target throttle opening angle $\theta t$ is carried out by the subroutine of FIG. 6.

In step 521, a basic throttle opening angle $\theta t_1$ is computed depending on the accelerator depression angle $\theta a$.

In step 522, a basic throttle opening area $At_1$ is computed from the basic throttle opening angle $\theta t_1$.

In step 523, a target throttle opening area At is computed by the relation $At = At_1 \times AFR/14.7$, where 14.7 is the theoretical AFR.

Figure 2:
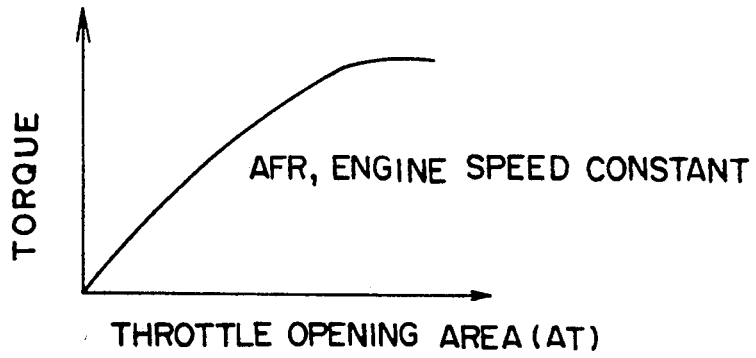
FIG. 2 is a graph showing a preferred relation between throttle opening area and torque produced according to this invention.

If the AFR and the engine speed are both constant, the torque produced by the engine is effectively directly proportional to the throttle opening area At as shown in FIG. 2.

Figure 3:
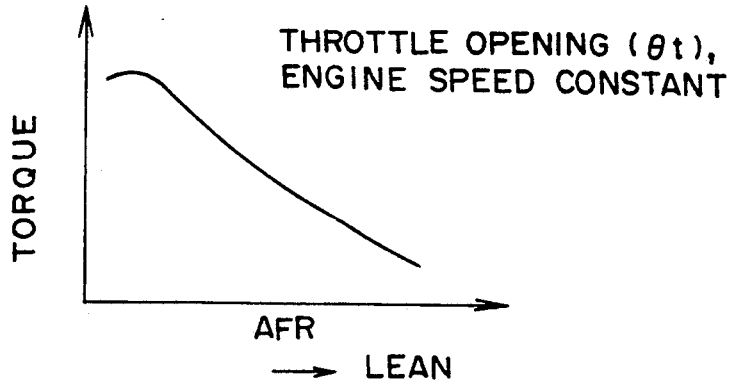
FIG. 3 is a graph showing a preferred relation between AFR and torque produced according to this invention.

Further, if the throttle opening angle $\theta t$ and the engine speed are both constant, the torque produced by the engine is effectively inversely proportional to the AFR as shown in FIG. 3 when the AFR is lean.

If the value obtained by dividing the throttle opening area At by the AFR, i.e., At/AFR, is held constant, step changes in the torque produced by the engine when the AFR is changed over are eliminated. In other words, to eliminate the steps in the engine torque, the throttle opening angle $\theta t$ with respect to the accelerator depression angle $\theta a$ should be set such that At/AFR is constant before and after changing over from the theoretical AFR to a lean AFR.

Figure 4:
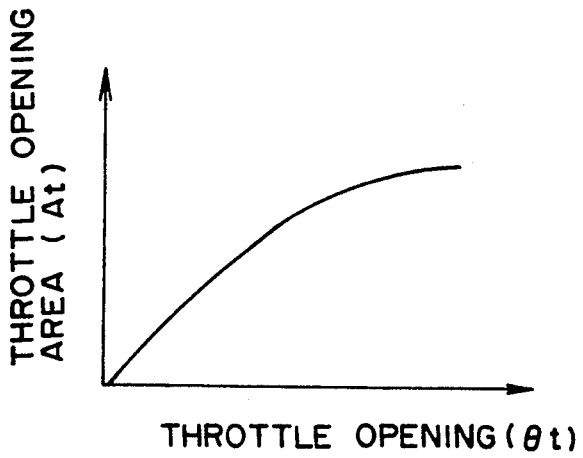
FIG. 4 is a graph showing a preferred relation between throttle opening and throttle opening area according to this invention.

In step 524, a target throttle opening angle $\theta t$ is computed from the target throttle opening area At. The throttle opening area At and throttle opening angler $\theta t$ are in a linear relation as shown in FIG. 4.

Figure 5:
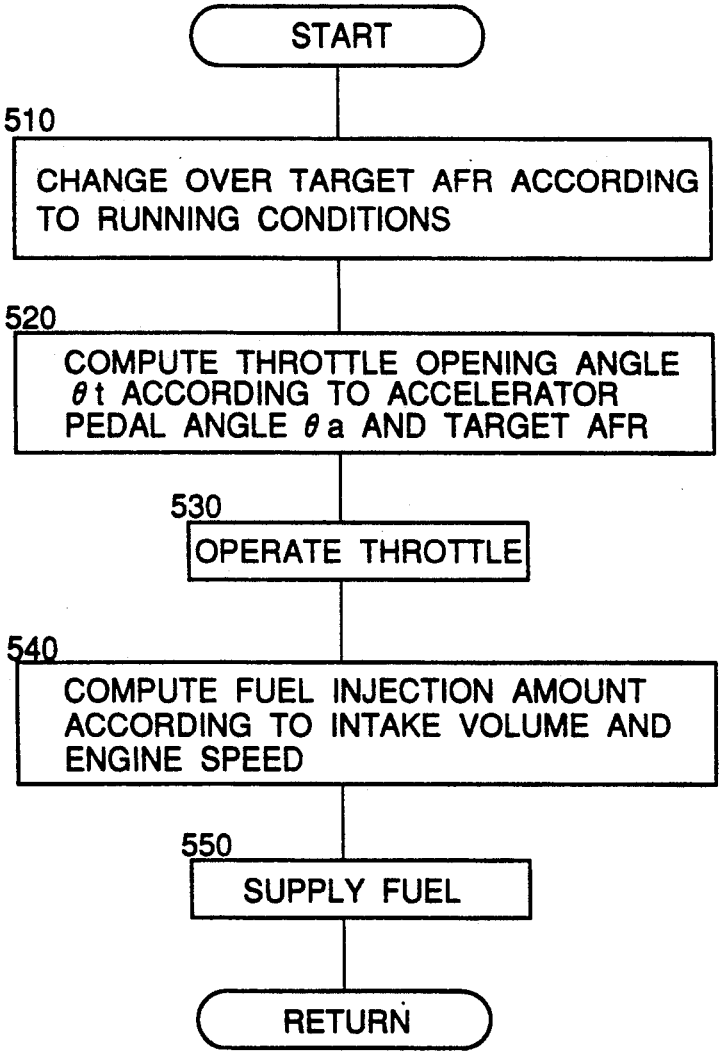
FIG. 5 is a flowchart showing steps in the process for controlling throttle operation and fuel injection according to this invention.

Next, the program proceeds to a step 530 in FIG. 5 wherein the opening and closing of the throttle valve 6 is driven by the throttle actuator 21 such that the computed target throttle opening angle $\theta t$ is obtained.

In step 540, a fuel injection amount is computed according to the detected intake air volume and engine speed.

In step 550, fuel is supplied via the injector 7 such that the computed fuel injection amount is obtained.

As a result, as shown in FIG. 6, the throttle opening and intake air volume are temporarily reduced when there is a change-over from a lean AFR to the theoretical AFR.

Consequently, there is not sudden increase in the fuel amount supplied, and the torque produced by the engine increases smoothly with the accelerator depression.

In contrast, in conventional devices, wherein the throttle opening is changed unconditionally with respect to the accelerator depression, the fuel amount supplied increases sharply when the target AFR is changed over from the theoretical AFR to a leaner AFR, and steps occur in the torque produced by the engine.

In the aforesaid embodiment, the opening of the throttle valve 6 is controlled by the control unit 50, but this invention can also be applied to an engine wherein a throttle opening ratio varying mechanism is provided between the accelerator pedal 3 and the throttle valve 6 such that it can vary the ratio of the accelerator depression angle to the throttle opening angle. Such a throttle opening ratio varying mechanism is disclosed in, for example, U.S. Pat. No. 5,078,108.

Figure 8:
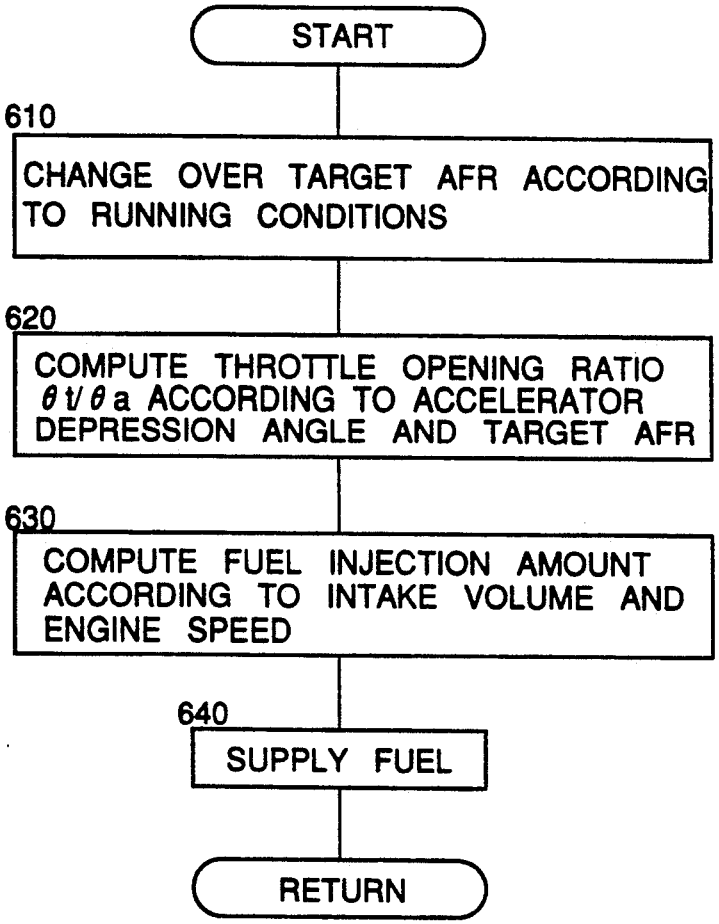
FIG. 8 is a flowchart showing the process for controlling throttle operation and fuel injection according to another embodiment of this invention.
Figure 9:
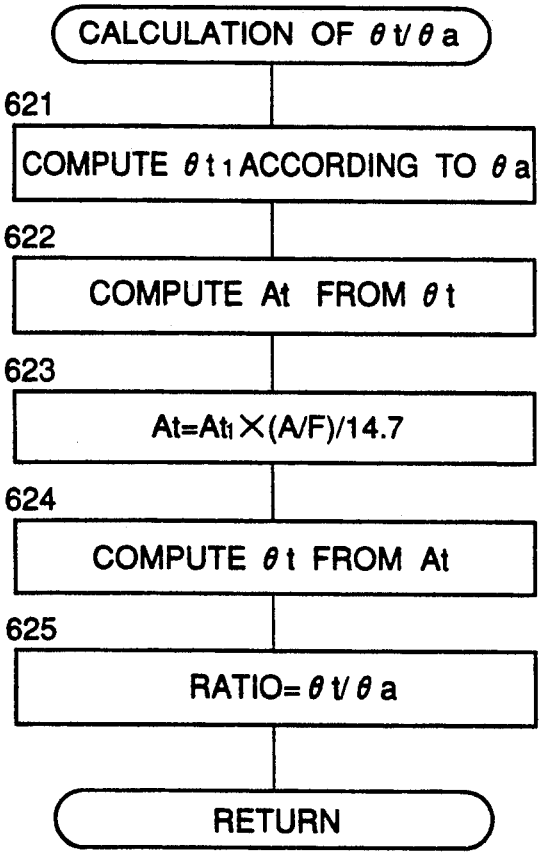
FIG. 9 is a flowchart showing the process for computing the target throttle opening ratio according to another embodiment of this invention.

The control operations of the control unit 50 which are performed in this case are shown in the flowcharts of FIG. 8 and FIG. 9.

Step 610 is the same as the step 510 of FIG. 5.

In step 620, the throttle opening ratio $\theta t/\theta a$ is computed according to the depression angle $\theta a$ of the accelerator pedal 3 and the target AFR.

This computation of the throttle opening ratio $\theta t/\theta a$ will now be described according to the subroutine of FIG. 9.

Steps 621–624 are the same as the steps 521–524 of FIG. 6. In step 625, the throttle opening ratio $\theta t/\theta a$ is computed.

The program proceeds to step 630, and the throttle opening ratio varying mechanism changes the throttle opening ratio to the target ratio $\theta t/\theta a$.

In step 640, a fuel injection pulse width Ti as fuel injection amount is computed according to the following relation:

$$Ti = Tp \times (14.7/\text{target } AFR) \times COEF \times (\alpha + L\alpha - 1) + Ts$$

wherein Tp is a basic pulse width computed according to the detected intake air volume and the engine speed, COEF are various predetermined correction coefficients, $\alpha$ is an AFR feedback correction coefficient, $L\alpha$ is an AFR learning correction coefficient, and Ts is an ineffectual pulse width.

In step 650, fuel is supplied via the injector 7 such that this computed fuel injection amount is obtained.

By driving the throttle opening ratio varying mechanism depending on the change-over of the target AFR so as to vary the ratio of the accelerator angle and throttle opening, torque shocks are prevented and change-over of the AFR takes place smoothly.

The foregoing description of the preferred embodiments for the purpose of illustrating this invention is not to be considered as limiting or restricting the invention, since many modifications may be made by those skilled in the art without departing from the scope of the invention.

The embodiments of this invention in which an exclusive property or privilege is claimed are defined as follows:

1. A power controller for an engine provided with a combustion chamber, a throttle having a variable opening area to regulate an intake air volume supplied to said combustion chamber, an accelerator which operates said throttle, and means for supplying a fuel to said combustion chamber, comprising:

means for selecting an air-fuel ratio from among a plurality of candidate air-fuel ratios;

means for computing a target throttle opening area based on an operation amount of said accelerator and the selected air-fuel ratio;

means for correcting an opening of said throttle such that an opening area thereof is equal to the computed target throttle opening area, said correcting means comprising a throttle opening ratio varying mechanism which mechanically connects said accelerator and said throttle and varies the ratio of the accelerator operation amount to the throttle opening area based on the target throttle opening area;

means for detecting an intake air volume;

means for detecting an engine speed;

means for computing a fuel amount based on the selected air-fuel ratio, detected intake air volume and detected engine speed; and means for regulating a fuel amount supplied by said fuel supplying means in correspondence with the computed fuel amount.

2. The engine power controller according to claim 1, wherein:

said target throttle opening area computing means computes said target throttle opening area such that a ratio of the target throttle opening area and the selected air-fuel ratio is maintained when a different air-fuel ratio is selected.

3. The engine power controller according to claim 1, wherein:

said correcting means comprises a throttle actuator which can vary the throttle opening area independently of the accelerator operation according to the target throttle opening area.

* * * * *